US005938025A

United States Patent [19]

Chernack

[11] Patent Number: 5,938,025

[45] Date of Patent: Aug. 17, 1999

[54] LOST BUTTON REPLACEMENT METHOD AND APPARATUS

[76] Inventor: Milton Chernack, 15 West 55th St., Suite 6B, New York, N.Y. 10019

[21] Appl. No.: 09/066,226

[22] Filed: Apr. 24, 1998

Related U.S. Application Data

[60] Provisional application No. 60/045,099, Apr. 25, 1997.

[51] Int. Cl.[6] ..... A44B 1/18; D05B 3/14

[52] U.S. Cl. ..... 206/348; 24/114.6; 2/265

[58] Field of Search ..... 24/114.6, 114.9, 24/693; 206/348; 2/265

[56] References Cited

U.S. PATENT DOCUMENTS

| | | | |
|---|---|---|---|
| 2,302,045 | 11/1942 | Neumann | 206/348 |
| 2,671,219 | 3/1954 | Levi | 2/265 |
| 3,997,052 | 12/1976 | Eddy et al. | 206/348 |
| 4,705,167 | 11/1987 | Nakamura | 206/348 |
| 5,379,888 | 1/1995 | Rentos | 206/348 |

*Primary Examiner*—Bryon P. Gehman
*Assistant Examiner*—J. Mohandesi
*Attorney, Agent, or Firm*—Cohen, Pontani, Lieberman & Pavane

[57] ABSTRACT

A replacement button assembly comprises a replacement button, a carrier sheet for securing and carrying the replacement button, a pressure-sensitive adhesive sheet underlying the carrier sheet, and an adhesively removable backing sheet underlying the adhesive sheet. Such replacement button assembly can be easily adhered to a garment after the removable backing sheet is stripped from the assembly. The present invention also provide a process of making the replacement button assembly.

8 Claims, 4 Drawing Sheets

LOST BUTTON REPLACEMENT METHOD AND APPARATUS

This application claims benefit of Provisional Application No. 60/045,099 filed Apr. 25, 1997.

BACKGROUND OF THE INVENTION

1. Field of the Invention

The present invention relates to a replacement button assembly adhesively connectable to a garment without needle and thread. The present invention also relates to a method of making the replacement button assembly.

2. Description of the Related Art

The detachment or loss of a button from a garment requires replacement, which needs some time to accomplish and also some deftness with a needle and thread. The present invention provides a method to simplify this process.

SUMMARY OF THE INVENTION

An object of the present invention is to provide a replacement button assembly that can be readily adhered to a cloth-like material. The replacement button assembly of the present invention includes a button secured to a carrier sheet, a pressure-sensitive adhesive sheet underlying the carrier sheet, and a removable backing sheet. Using the inventive button assembly, a lost button on a garment can be easily replaced simply by removing the backing sheet and manually pressing the carrier sheet with its underlying adhesive against the garment without additional operations.

Another object of the present invention is to provide an associated applicator, such as a clamp device, to facilitate the process of replacing the lost button on a garment.

A further object of the present invention is to provide a process for making a replacement button assembly by the steps of adhering a removable backing sheet to one surface of a pressure-sensitive adhesive sheet having two adhesive surfaces, punching a plurality of holes through the adhesive sheet and backing sheet assembly, adhering a carrier sheet to the other surface of the pressure-sensitive sheet, cutting through the carrier sheet to form a plurality of individual units, and securing a plurality of replacement buttons on each individual unit of the carrier sheet, alternatively a small number of buttons. Whenever needed, one button unit can be removed from the backing sheet for use.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein like reference number denotes similar elements throughout the several views.

DETAILED DESCRIPTION OF THE CURRENTLY PREFERRED EMBODIMENTS

Figure 1:
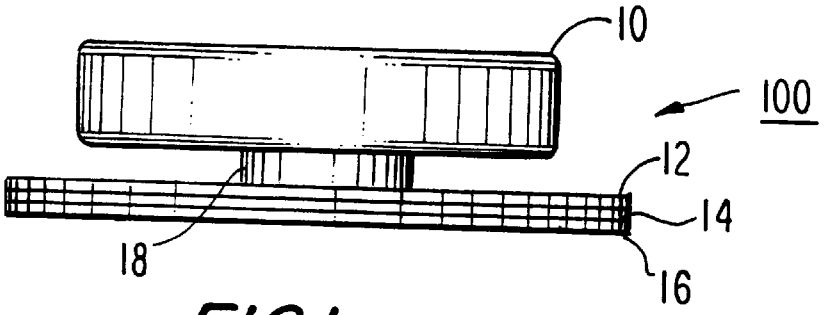
FIG. 1 is a side view of the replacement button assembly.

Referring now to FIG. 1, a replacement button assembly 100 comprises a replacement button 10 which is affixed by any suitable means 18, such as thread, a staple, a stud, or the like, to a carrier sheet 12, preferably in predeterminately spaced relation from other similar buttons. The preferred means for securing the replacement button 10 to the carrier sheet 12 is thread. Carrier sheet 12 may, for example, be made of cloth or a plastic such as mylar film, polyethylene film or polyurethane film or the like. It may be colored to match the garment or it may be made of a transparent material. Replacement button 10 may be of any configuration depending on the intended use. It is here shown, by way of example only, as an ordinary shirt button. Carrier sheet 12 to which the button 10 is affixed is preferably cut to the same shape as the configuration of replacement button 10 but is preferably slightly larger than the button. The most preferred shape of carrier sheet 12 is circular and approximately ⅝" diameter. Underneath carrier sheet 12 is a sheet of two-sided pressure-sensitive high tech adhesive or affixative coating 14, such as Adchem's 256M-60. While pressure-sensitive adhesive 14 is shown in FIG. 1 to be a sheet-like material, a liquid of a pressure-sensitive adhesive may be applied to form such a sheet directly on the back side of the carrier sheet. A removable protective backing sheet 16 is preferably attached to pressure-sensitive adhesive sheet 14 to prevent inadvertent adherence of the adhesive-carrying carrier sheet to another surface or object while replacement button assembly 100 is not in use.

Figure 6:
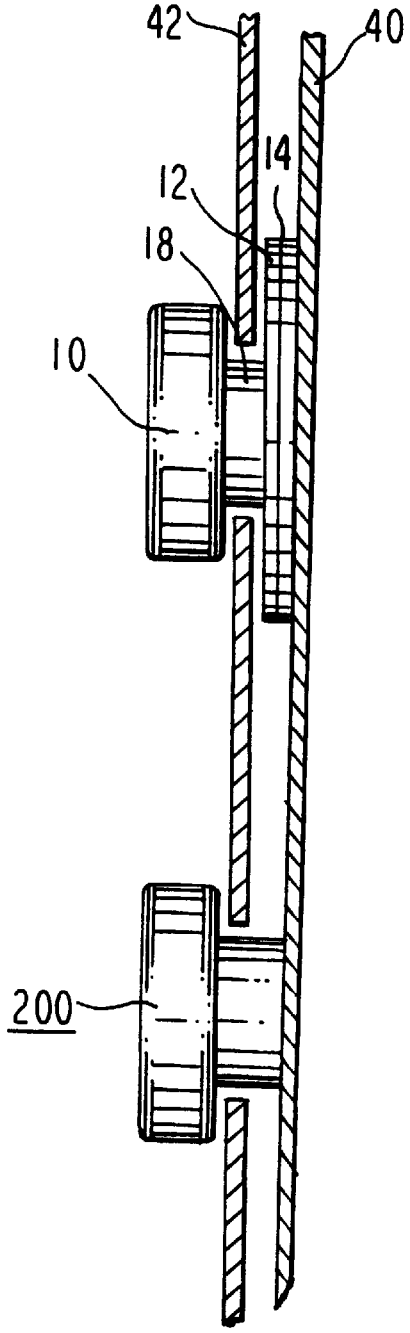
FIG. 6 is a side view of the replacement button placed on a garment and an original button on the same garment.
Figure 2:
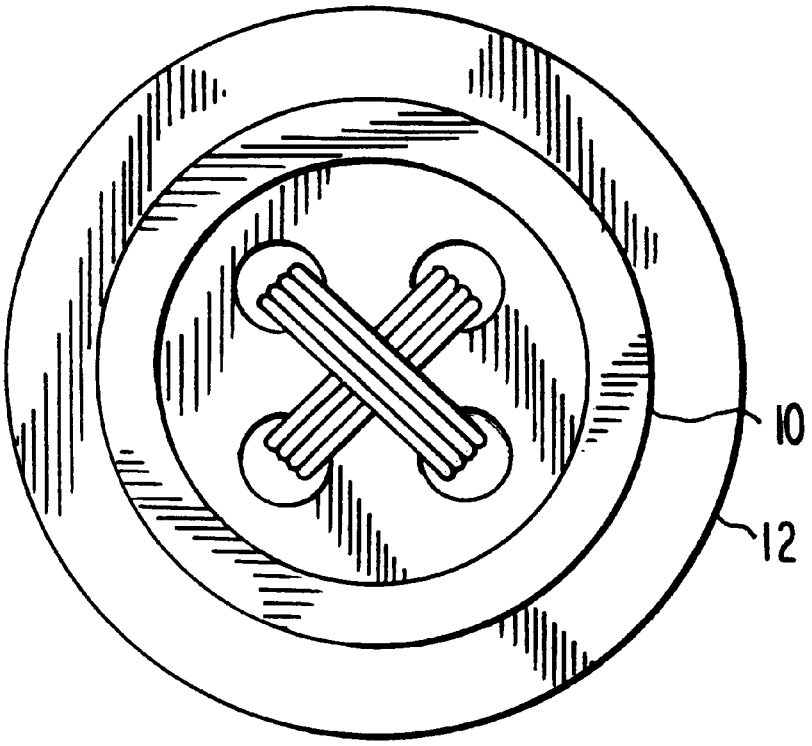
FIG. 2 is a top plan view of the replacement button assembly at FIG. 1.
Figure 3:
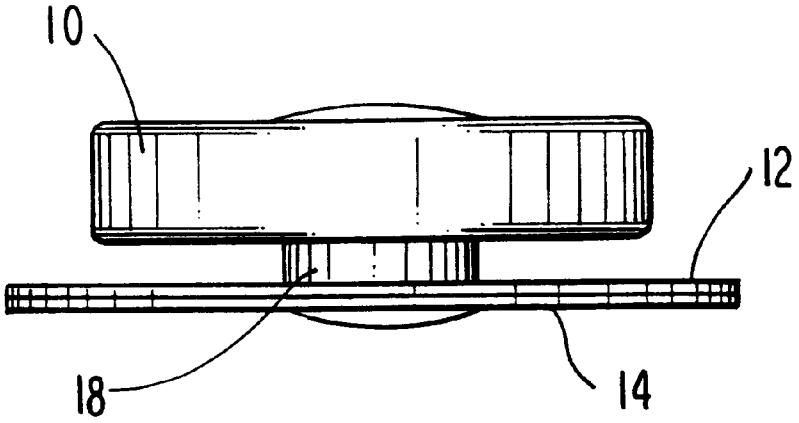
FIG. 3 is a side view of the replacement button assembly at FIG. 1 having the backing sheet removed.

When one desires to replace a lost or detached button, backing sheet 16 is stripped from a single unit of replacement button assembly 100 so as to expose pressure-sensitive sheet 14, as shown in FIG. 3. Then, the surface of carrier sheet 12 carrying the now-exposed pressure-sensitive adhesive 14 is pressed against the garment fabric in the location of the lost button so as to center the new button on the location of the old, now-detached or lost button, as shown in FIG. 6.

Figure 9:
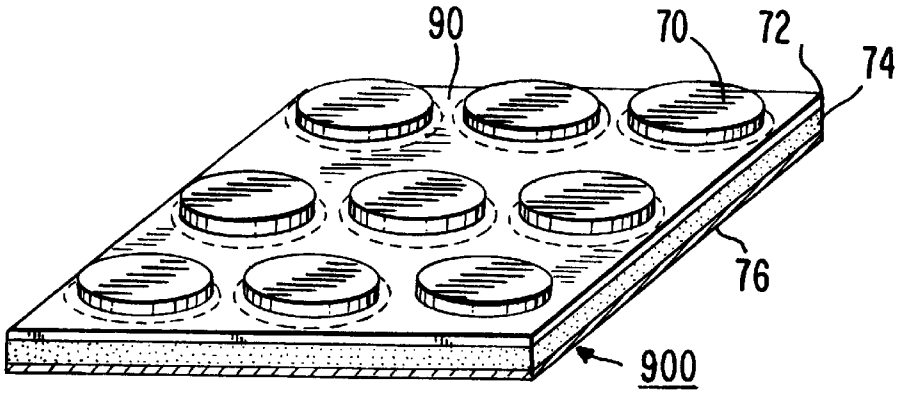
FIG. 9 is a perspective view of a unitary product of the replacement button assembly carrying a plurality of the replacement buttons.

The replacement button assembly may be provided in an alternative form, as a unitary product 900 as shown in FIG. 9, which includes a planar array of a plurality of replacement buttons 70 secured on a carrier sheet 72, the carrier sheet 72 being die-cut through about each button 70, a single pressure-sensitive adhesive sheet 74 underlying the carrier sheet 72, and a single continuous backing sheet 76 underlying the pressure-sensitive adhesive sheet 74. In use, an individual replacement button 70 together with a portion of the underlying carrier sheet 72 and a portion of the pressure-sensitive adhesive sheet 74 is stripped from the backing sheet 76 as a unit without disturbing the backing sheet 76 or the remaining button assemblies.

When affixing the button carrying material, i.e. the carrier sheet to a garment surface, sufficient pressure to create a smooth and strong bond between the button-carrying material and the surface of the garment is applied manually, i.e. by hand so that carrier sheet 12 of the inventive assembly lies flat on the garment surface.

Figure 4:
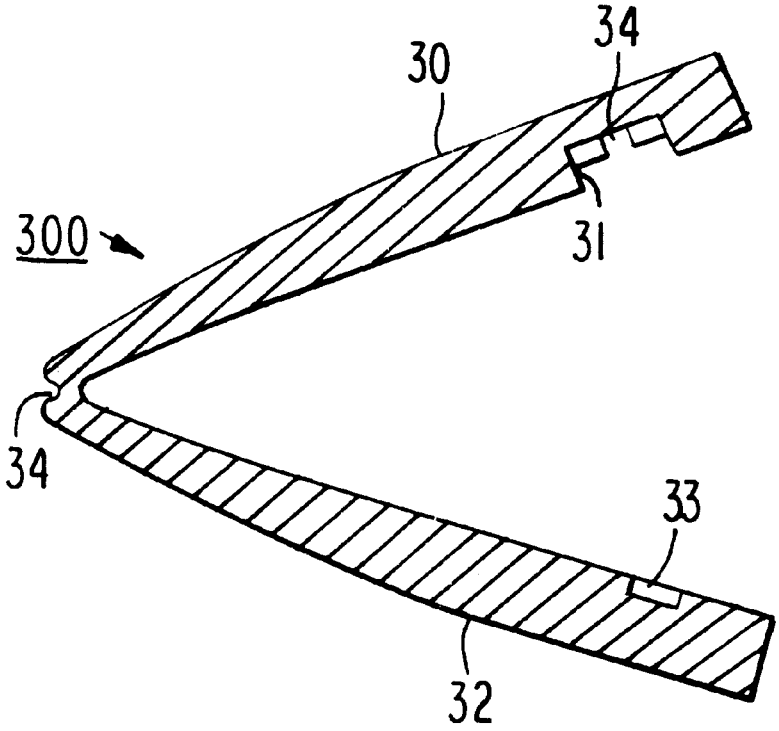
FIG. 4 is a side view of a clamp device.
Figure 5:
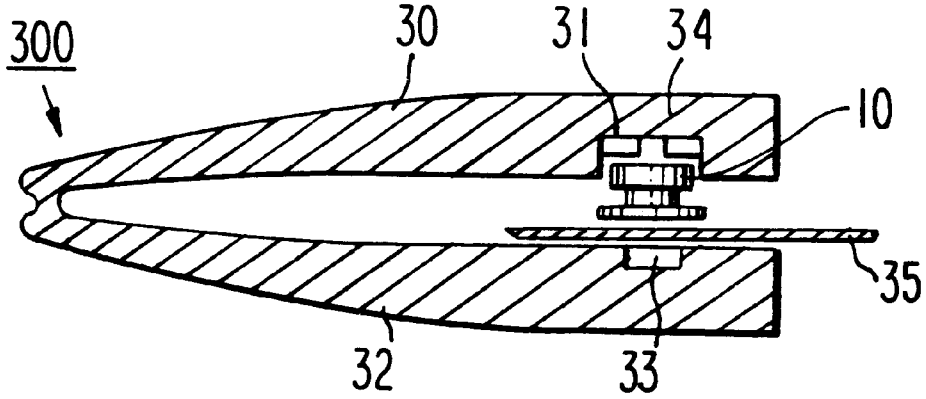
FIG. 5 is a side view of the clamp device at FIG. 4 in use, showing how the clamp is applied to replace a lost button.

Alternatively, or in addition, pressure may be applied utilizing an associated flexible clamping device, such by way of example as that shown in FIGS. 4 and 5, to facilitate an enhanced bond between the button-carrying carrier sheet of assembly 100 and the garment surface by assisting interengagement of the pressure-sensitive adhesive with the fibers of the garment fabric. As shown in FIG. 4, a clamp 300 for enhancing the securement of replacement button 10 to a portion of garment fabric 35 comprises a first arm 30, a second arm 32, and a hinge 34 connecting first arm 30 and second arm 32 to form a V-shaped structure. The clamp is preferably made of a plastic such as polypropylene and hinge 34 is preferably an integral living hinge. A well 34 is formed at the free end of first arm 30 for receiving replacement button 10 of replacement button assembly 100. An annular insert 31, preferably made of a resilient material such as rubber, is preferably inserted into well 34 and seated on the bottom of well 34 so as to form a donut-like seat such that the insert 31 may be deformably pressed by replacement button 10 in accordance with the thickness of the button. A recess 33 is preferably formed at the free end of second arm 32 for receiving securing means 18 extending from the bottom of the replacement button assembly 100.

FIG. 5 is a side view of clamp 300 in use. While the free end of first arm 30 is applied on one side of a garment fabric 35, i.e. the button side, the free end of second arm 32 is applied on the other. When the two free ends of clamp 300 are forced to meet each other by opposing forces applied on the two arms 30, 32, adhesion between the replacement button positioned on the garment fabric 35 is enhanced.

In another embodiment of the present invention, an alternative adhesive or affixative coating, which is one half of a two-component adhesive system, may be employed underlying carrier sheet 12 of replacement button assembly 100 to form adhesive sheet 14. When it is desired to use the replacement button, the user simply applies the second component of the adhesive system to the carrier sheet surface that already carries the first component and, then, affixes the replacement button to the surface of the garment fabric as described above. Such a two-phase system may for example comprise an epoxy such as bis-phenol A and epichlorhydrine.

FIG. 6 is a side view of the replacement of a lost button on a garment, showing a replacement button 10 affixed to a button carrying portion 40 of the garment at the location of a lost or detached button and an original button 200 located below the replacement button 10. The carrier sheet 12 of replacement button assembly 100 is inconspicuous in use since the carrier material will, in use, be completely covered by an overlapping garment portion 42 with which the replacement button 10 and the original button are engaged. Moreover, by using a transparent material as the button carrier in the inventive assembly, the fabric of the garment will be visible through the carrier material and the assembly will thereby be rendered relatively invisible.

The thereby-affixed replacement button may then be used immediately in the manner of the original button. Within 24 hours, the preferred single phase adhesive described above will cure, thus allowing the garment to be washable without loss or detachment of the replacement button.

Figure 7:
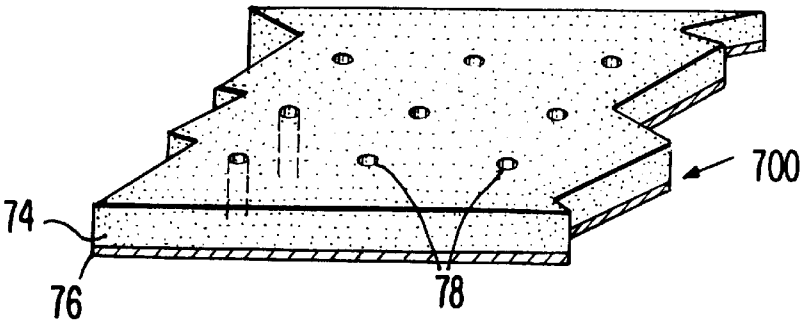
FIG. 7 is a perspective view of an adhesive-backing sheet assembly having a plurality of holes.
Figure 8:
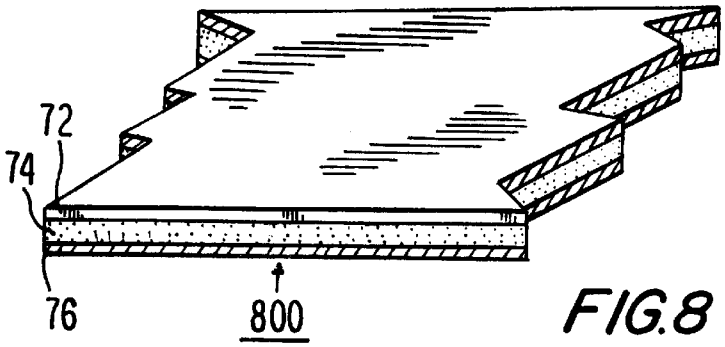
FIG. 8 is a perspective view of a sandwich-like assembly having a carrier sheet, a pressure-sensitive adhesive sheet and a backing sheet.

The replacement button assembly in accordance with the above description is preferably assembled in a process described hereinafter with reference to FIGS. 7 and 8. An adhesive-backing sheet assembly 700 is assembled by adhering a detachable backing sheet 76 to one surface of a pressure-sensitive adhesive sheet 74 having two adhesive surfaces, as shown in FIG. 7. A plurality of holes 78 are punched through adhesive-backing sheet assembly 700 in a predeterminately spaced relation. As shown in FIG. 8, a carrier sheet 72 is then adhered to the other surface of pressure-sensitive adhesive sheet 74 to form a sandwich-like assembly 800. While this sandwich-like assembly 800 may be of any size, it is preferably a continuous belt and may be later cut into any desirable sizes. Then, the carrier sheet is die-cut around each hole, with or without penetrating the underlying pressure-sensitive adhesive sheet, to form a plurality of units having configurations similar to but slightly larger than the replacement buttons. The portion 90, in FIG. 9, of carrier sheet 72 that is not the part of any unit may be removed from backing sheet 76 such that the non-unit portion of the backing sheet is exposed. This step may facilitate a later removal of the carrier sheet units from the backing sheet. As shown in FIG. 9, each of a plurality of replacement buttons 70 is then secured on each unit of the die-cut carrier sheet 72 of sandwich-like assembly 800 in a matching relation from the plurality of holes 78 by any suitable means, preferably by thread, leaving the means for securing buttons in the holes 78 such that to prevent the securing means to engage with backing sheet 76. The units so formed are separably and separately held on the detachable backing sheet. When needed, a unit of button-carrying carrier sheet may be readily removed from the backing sheet without disturbing the underlying backing sheet and the remaining units.

While there have been shown and described and pointed out fundamental novel features of the present invention as applied to a preferred embodiment thereof, it will be understood that various omissions and substitutions and changes in the methods described and in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

I claim:

1. A replacement-button assembly for attachment to a cloth-like article, comprising:

a. a button of a predetermined configuration;

b. a carrier sheet, means for securing said button to said carrier sheet, said carrier sheet having a first surface facing said button and a second surface opposite to said first surface;

c. a pressure-sensitive adhesive sheet adhering to said second surface of said carrier sheet, said pressure-sensitive adhesive sheet having an adhesive sheet hole, which is concentric with and dimensioned smaller than said button;

d. a backing sheet adhesively detachably connected to said pressure-sensitive adhesive sheet, said backing sheet having a backing sheet hole which is concentric with and dimensioned smaller than said button, said backing sheet hole being arranged in alignment with said adhesive sheet hole.

2. The replacement-button assembly of claim 1, wherein said means for securing said button is thread sewn into said button and said carrier sheet.

3. The replacement-button assembly of claim 1, wherein said carrier sheet and said pressure-sensitive adhesive sheet are dimensioned slightly larger than said button.

4. A unitary product including a plurality of replacement button assemblies, comprising:

a. a carrier sheet having a first and a second surface;

b. a plurality of buttons of predetermined configuration in a planar array in confronting relation with said first surface of said carrier sheet;

c. a plurality of means for securing said plurality of buttons to said carrier sheet;

d. a pressure-sensitive adhesive sheet adhering to said second surface of said carrier sheet, said pressure-sensitive adhesive sheet having a plurality of adhesive sheet holes in alignment with said plurality of buttons, each of said holes being concentric with and dimensioned smaller than each of said buttons; and e. a backing sheet adhesively, detachably connected to said pressure-sensitive adhesive sheet, said backing sheet having a plurality of backing sheet holes in alignment with said plurality of buttons each of said backing sheet holes being concentric with and dimensioned smaller than each of said buttons, the portions of said carrier sheet underlying said buttons being detached from the remainder of said carrier sheet and being removably held relative to said remainder of said carrier sheet by said pressure-sensitive adhesive and said backing sheet, whereby an individual button, its underlying portion of said carrier sheet and said pressure-sensitive adhesive sheet adhering thereto can be removed as a unit without disturbing said backing sheet.

5. A process for making a replacement-button assembly, comprising the steps of:

a. detachably adhering a backing sheet to a first surface of a pressure sensitive adhesive sheet to form a adhesive-backing sheet assembly;

b. punching a plurality of holes in a predeterminately spaced relation through said adhesive-backing sheet assembly;

c. adhering a carrier sheet to a second surface of said pressure-sensitive adhesive sheet;

c. cutting through said carrier sheet around each of said plurality of holes to form a plurality of individual units, so that said plurality of units are held separably relative to each other on said backing sheet.

e. securing each of a plurality of replacement buttons on said individual units of said carrier sheet in a matching relation with said plurality of holes, said each of said replacement buttons being secured on said carrier sheet without being connected with said adhesive-backing sheet assembly.

6. The process of claim 5, further comprising the step of cutting through said pressure-sensitive adhesive sheet underlying said carrier sheet to form a plurality of individual units so that said plurality of units are held separably relative to each other on said backing sheet.

7. The process of claim 5, wherein said carrier sheet and said pressure-sensitive adhesive sheet of each said units is cut to form a configuration slightly larger than the configuration of said buttons.

8. The process of claim 5, further comprising removing a portion of said carrier sheet that does not belong to any said individual units of said carrier sheet from said backing sheet so as to expose a portion of said backing sheet.

* * * * *